US006450298B1

(12) United States Patent
Koura et al.

(10) Patent No.: US 6,450,298 B1
(45) Date of Patent: Sep. 17, 2002

(54) COMMUNICATIONS CONTROL SYSTEM FOR ELEVATORS

(75) Inventors: Kunikazu Koura; Hiroshi Gokan; Junya Tanaka; Keita Yamaguchi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/930,463

(22) Filed: Aug. 16, 2001

(30) Foreign Application Priority Data

May 1, 2001 (JP) ..... 2001-134061

(51) Int. Cl.[7] ..... B66B 1/28; B66B 1/16

(52) U.S. Cl. ..... 187/247; 187/382

(58) Field of Search ..... 187/247, 248, 187/380, 382, 384, 388, 391; 340/2.1, 2.21, 2.24, 3.1, 3.2, 3.32, 3.5, 3.52, 3.54, 825.2, 825.21

(56) References Cited

U.S. PATENT DOCUMENTS 4,709,788 A * 12/1987 Harada ..... 187/382
5,654,531 A * 8/1997 Farabee et al. ..... 187/247
5,804,778 A * 9/1998 Chen et al. ..... 181/248
5,884,729 A * 3/1999 Park et al. ..... 187/248
5,936,211 A * 8/1999 Kim ..... 187/248
5,955,708 A * 9/1999 Amano et al. ..... 187/247
6,021,870 A * 2/2000 Kim ..... 187/247
6,349,795 B1 * 2/2002 Tatsumi et al. ..... 187/247

FOREIGN PATENT DOCUMENTS

JP 61-295979 A 12/1986
JP 62-116483 A 5/1987
JP 6-80322 A 3/1994
JP 9-149061 A 6/1997

* cited by examiner

*Primary Examiner*—Jonathan Salata
(74) *Attorney, Agent, or Firm*—Leydig, Voit & Mayer, Ltd.

(57) ABSTRACT

A communications control system for elevators in which synchronization instructions do not result in all units bearing data receiving loads, and smooth data transfer may be realized. A node acting as a master sends synchronization start data to one slave from among many slaves; receives synchronization completion data from the slave, and sends subsequent synchronization start data to a subsequent slave, in order; and adjusts the timing for sending synchronization start data sending so that it matches a target cycle, assuming that an interval for sending the synchronization start data is a synchronization start data sending cycle, based on: amount of time from the sending of the synchronization start data until the receiving of the synchronization completion data; an amount of time required for sending the data, being calculable from the number of sending data stored in a sending buffer until the time of sending; and a target time for the synchronization start data sending cycle.

5 Claims, 19 Drawing Sheets

FIG. 2

| | | | | | | |
|---|---|---|---|---|---|---|
| ALIVE/DEAD IDENTIFIER | MASTER/ SLAVE | POSITION | ATTRIBUTE | NODE NUMBER #1 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #2 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #3 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #4 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #5 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #6 | LOGICAL NETWORK ADDRESS | PHYSICAL NETWORK ADDRESS |
| ALIVE/DEAD IDENTIFIER | MASTER/ SLAVE | POSITION | ATTRIBUTE | NODE NUMBER #7 | LOGICAL NETWORK ADDRESS | PHYSICAL NETWORK ADDRESS |
| ⋮ | ⋮ | ⋮ | ⋮ | ⋮ | ⋮ | ⋮ |
| ALIVE/DEAD IDENTIFIER | MASTER/ SLAVE | POSITION | ATTRIBUTE | NODE NUMBER #n | LOGICAL NETWORK ADDRESS | PHYSICAL NETWORK ADDRESS |

COMMUNICATIONS CONTROL SYSTEM FOR ELEVATORS

This application is based on Application No. 2001-134061, filed in Japan on May 1, 2001, the contents of which are hereby incorporated by reference.

BACKGROUND OF THE INVENTION

1. Field of the Invention

The present invention relates to operation management of a plurality of elevators installed inside a building, and a communications control system for elevators capable of decreasing both waiting time that an elevator passenger waits to board an elevator and waiting time that the elevator passenger waits to arrive at a desired target floor, and also is resistant to failure.

2. Description of the Related Art

Explanation is made of a conventional communications control system for elevators, making reference to the drawings.

FIG. 21 is a diagram showing a construction of a conventional communications control system for elevators shown in Japanese Patent Application Laid-open No. Hei 6-80322.

In this conventional communications control system for elevators, as shown in FIG. 21, three control units 91, 92 and 93 for controlling three elevators are provided as an example.

Each control unit 91, 92 and 93 has a car control unit CCa, CCb and CCc each controlling its own elevator, and in addition to this, each control unit 91, 92 and 93 is integrally equipped with a group control unit GCa, GCb and GCc for group management control processing being made compact for distributed processing, and a hall control unit HCa, HCb and HCc for hall call control processing.

Each control unit 91, 92 and 93 additionally has an LSI (large-scale integrated circuit) Sa, Sb and Sc for transmitting, and information output from these is transmitted via a bus-form high speed transmission line 94.

On the hall side, corresponding to the way this example is configured into two series, a hall controller 95 comprising a one-chip microcomputer (one-chip micon) is provided for each series of each hall. Each hall controller 95 is expressed by both a number (1 or 2) following the symbol S for indicating the series type and a number (1-m) for indicating the hall type. For example, the hall controller 95 on series 1 side at floor m is specified as S1m.

These hall controllers 95 perform, for example, input processing of a hall call registration signal from a hall call registration button 96 and output processing of a lighting signal to a hall call registration lamp 97. Further, these hall controllers 95 are connected in a parallel fashion to a master node CPU Ma, Mb and Mc of each control unit 91, 92 and 93 via a transmission line 98, 99 in each series.

Any one of the plurality of control units 91–93 is set as a main unit for dividing up work among the elevators and establishing synchronization among each control unit. The other control units are configured as sub units obeying the above-mentioned main unit. Control functions requiring real time processing are processed by the main unit performing control processing on the control units of all the series in a synchronized fashion. Control functions requiring cyclic processing are processed by dividing them up among the control units of each series.

The conventional communications control system for elevators described above had a problem in that synchronization instructions for the cyclic processing caused a useless burden for the sub units that was not clearly related to the given communication.

Further, in the case of the conventional communications control system for elevators described above, there was a problem that when a method was used such that the sub unit side detected collisions of transmissions and staggered transmission times, when there were ten-plus sub units or more, answer collisions were expected, and in order to receive all answers, the waiting times of the main unit became widely varied. Transmission of large amounts of faulty data generated with the answer collisions caused the network to be weighed down with useless traffic.

Further, in the case of the conventional communications control system for elevators mentioned above, it is considered that network break up and failure cause data collisions on the network. Thus, there was a problem in that it was difficult to transmit and receive data correctly at all units, and furthermore, there was a possibility that network break up may cause all the main units to disappear. When time was taken up for restoring failures caused by such erroneous processing, there was a possibility that serious trouble may be caused in the operation of the elevator which handles human life.

Further, in the case of the conventional communications control system for elevators mentioned above, it is considered that when network connection failure causes two or more networks to collide, the simultaneous operation of two or more main units may create a data collision on the network. Thus, there was a problem that it was difficult to simultaneously transmit synchronization instructions separately and transmit and receive data correctly at all units. Furthermore, there was a possibility that the collision may cause all the main units to disappear. When time is taken up for restoring failures caused by such erroneous processing, there was a possibility that serious trouble may be caused in the operation of the elevator which handles human life.

Next, explanation is made of a master conflict control method according to a conventional communications control device, making reference to the drawings.

FIG. 22 shows a construction of a communications control system shown in Japanese Patent Application Laid-open No. Hei 9-149061. The communications control device shown in FIG. 22 provides a conflict method for performing a unique control in the case when a plurality of masters mistakenly exist on the same transmission channel. In order to enable transition to a master in response to instructions from a superior calculator, each control station 82 has a master function 83.

Control stations 82 having become masters issue master notifications at predetermined periods containing their respective priority levels, and simultaneously transmit them. However, in the case when a control station 82 that has received a master notification is also in master status itself, the priority level of the master notification and the priority level of this control station 82 are compared, and in the case when this control station 82 has a lower priority it becomes a slave.

However, in the case of the conventional communications control device mentioned above, a node behaving as a master sends synchronization start data to one slave among a plurality of slaves, receives synchronization completion data from the slave, and then sends subsequent synchronization start data to a subsequent slave in order. However, there was a problem that when synchronization start data and synchronization completion data are transmitted and received to and from the slaves in this way, the synchronization start data and the synchronization completion data occupy a large proportion of the data relative to the elevator operation that is originally supposed to be transmitted and received. Thus, the network load on both the masters and the slaves increased.

SUMMARY OF THE INVENTION

The present invention was developed to solve the above-mentioned problems. Therefore, an object of the present invention is to obtain a communications control device for elevators in which synchronization instructions do not create a load on data reception in all the units and which is capable of realizing smooth data transfer.

In order to attain the above object, according to an aspect of the present invention, a communications control system for elevators having a plurality of control units including respective car control units and elevator hall registration control units, each of said plurality of control units having a node, the plurality of nodes being connected to each other via a network, and each of said node having a management table establishing correspondence between a node number and a network address, said elevator communications control system comprising: a node acting as a master when, in the case where a first network address corresponding to the node number of this node is, upon referring to the management table, a specific address in the management table, this node sends to all other nodes a broadcast communication to notify that this node is a temporary master having the first network address added thereto and receives from another temporary master a broadcast communication for notifying that this other node is the temporary master having a second network address corresponding to the node number of this other temporary master added thereto, if the first network address and the second network address conform to specific conditions; and a node acting as a slave when, in a case where the network address corresponding to the node number of this node is not a specific address in the management table or the first network address corresponding to the node number of this node is a specific address in the management table upon referring to the management table, this node sends to all other nodes a broadcast communication to notify that this node is a temporary master having the first network address added thereto and receives from another temporary master a broadcast communication for notifying that this other node is the temporary master having a second network address corresponding to the node number of this other temporary master added thereto, if the first network address and the second network address do not conform to specific conditions, wherein said node acting as the master sends synchronization start data to one slave from among a plurality of slaves; receives synchronization completion data from the slave to send subsequent synchronization start data to a subsequent slave in order; and adjusts the timing for sending synchronization start data so that it matches a target cycle, assuming that an interval for sending the synchronization start data is a synchronization start data sending cycle, based on; an amount of time from the sending of the synchronization start data until the receiving of the synchronization completion data; an amount of time required for sending the data, being calculable from a number of sending data stored in a sending buffer until the time of sending; and a target time for the synchronization start data sending cycle.

According to another aspect to of the present invention, each of said nodes on the network monitors a network connection, stops at a time when the connection is electrically (physically) severed while maintaining the state immediately before the connection is severed, and continues monitoring the network connection, and wherein both the master node and slave nodes join the network in the state immediately before the connection is severed at a time when the network is restored and reconnection occurs.

According to another aspect to of the present invention, at the time when the network is restored, a node having a specific address as the master in the management table joins as the master at the time of the reconnection, even in the case when the node was a slave immediately before the connection was severed.

According to another aspect to of the present invention, in the case when the network is physically (electrically) severed and restoration takes place in each of the two severed networks takes and nodes operating as the masters on each of the networks are controlling those networks, when the severed connection is reconnected and a single network is formed again, the master nodes of each network compete for a master right of the single network, a single node capable of acquiring the master right is determined based on a compound condition of:

(1) a condition determined by judgment as to whether there exist slave nodes on the networks of the competing nodes or not; and (2) a condition determined by comparison of priority levels being defined by the network addresses in the management tables.

According to still another aspect to of the present invention, moving of the master right in the above-mentioned network to another node (slave) is realized by negotiation between the host CPUs of the nodes via the network.

BRIEF DESCRIPTION OF THE DRAWINGS

In the accompanying drawings:

FIG. 2 is an explanatory drawing showing a register of the communications control device according to Embodiments 1 to 3 of the present invention;

DETAILED DESCRIPTION OF THE PREFERRED EMBODIMENTS

Embodiment 1

Explanation is made of a communications control system for elevators according to Embodiment 1 of the present invention, making reference to the drawings.

Figure 1:
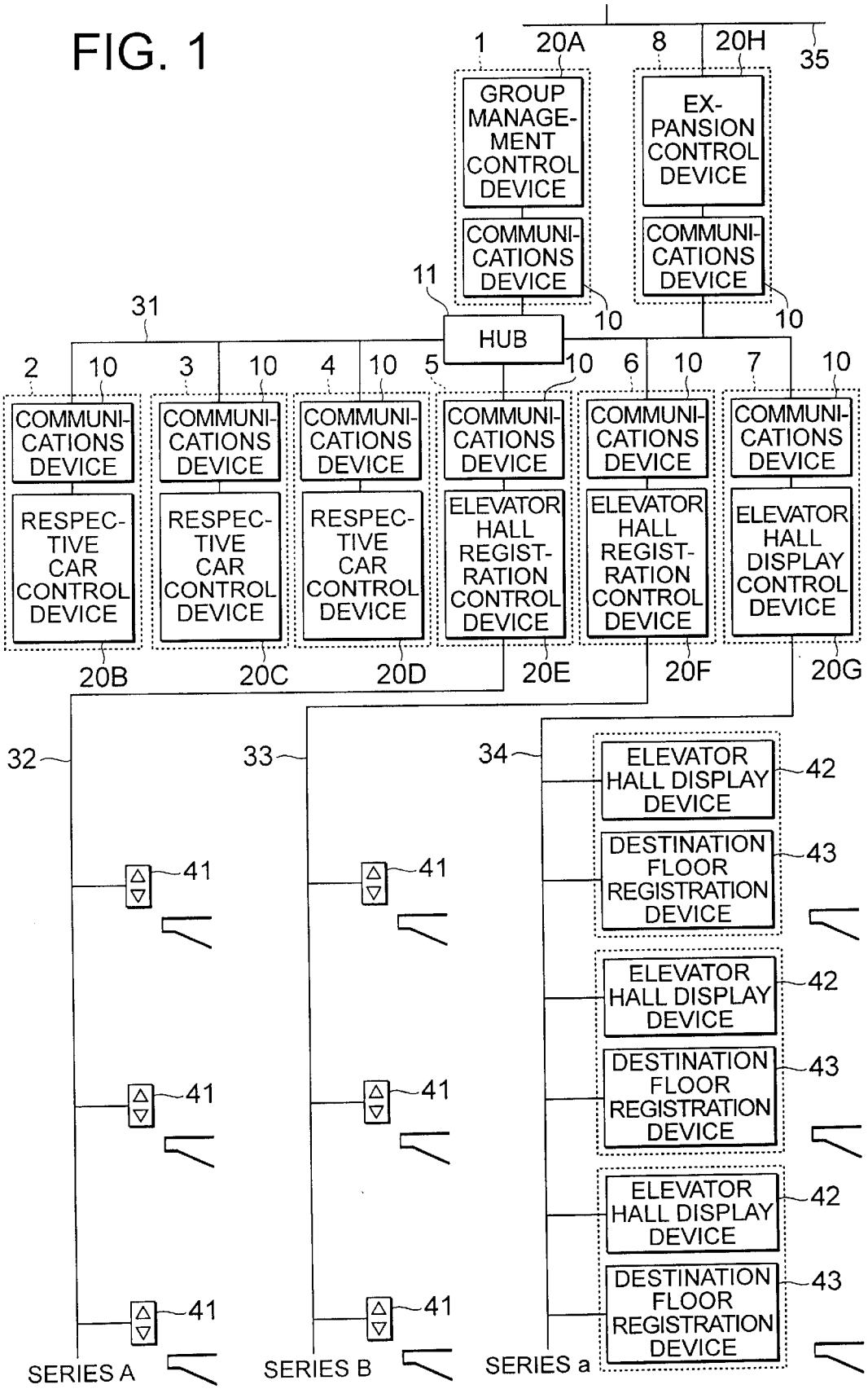
FIG. 1 is a block diagram showing a construction of a communications control system for elevators according to Embodiments 1 to 5 of the present invention.

FIG. 1 is a diagram showing a construction of a communications control system for elevators according to Embodiment 1 of the present invention. Further, the same reference numerals in each figure indicate identical or corresponding parts.

In FIG. 1, the communications control system for elevators is equipped with the following being connected via a transmission channel 31: a group management control unit 1; respective car control units 2–4; elevator hall registration control units 5–7; and an expansion control unit 8. It is considered that a hub 11 is installed to the transmission channel 31 as a line concentrator as shown in the diagram. The line concentrator is used for the purpose of building a network by connecting the nodes in a star formation.

Further, in the same diagram the group management control unit 1 has a communications device 10 and a group management control device 20A. This group management control unit 1 performs an allocation controls of elevator car (not shown) in response to a registered elevator hall call based on an elevator hall call registration signal.

Further, the respective car control unit 2 has the communications device 10 and a respective car control device 20B. This per elevator control unit 2 controls ascending and descending of the elevator car based on a car allocation signal originating from the group management control unit 1 for allocating cars in response to the elevator car call registration signal, and a car call signal originating from the car.

Similarly, the per elevator control unit 3 has the communications device 10 and a per elevator control device 20C, and the per elevator control unit 4 has the communications device 10 and a per elevator control device 20D. These respective car control units 3 and 4 have the same functions as the functions of the per elevator control unit 2. Note, the respective car control units 2, 3 and 4 and the car apparatus are joined by means of a transmission line, though this is not shown in the diagram of this example.

Further, the elevator car registration control unit 5 has the communications device 10 and an elevator hall registration control device 20E. This elevator hall registration control unit 5 controls, via the transmission line 32, input processing of the elevator hall call registration signal from an elevator hall button registration device 41 installed on each floor, and output processing of an elevator hall registration light signal from the group management control unit 1 responding to the elevator hall call. Note that, in this example the elevator hall registration control unit 5 handles the elevator hall call registration information and the elevator hall registration light information of the three elevators of series A controlled by the respective car control units 2–5.

Similarly, the elevator hall registration control unit 6 has the communications device 10 and an elevator hall registration control device 20F. This elevator hall registration control unit 6 has the same functions as the functions of the elevator hall registration control unit 5. Note that, in this example the elevator hall registration control unit 6 handles the elevator hall call registration information and the elevator hall registration light information of the three elevators of series B controlled by the respective car control units 2–5.

Further, an elevator hall display control unit 7 has the communications device 10 and an elevator hall display control device 20G. This elevator hall display control unit 7 controls, via a transmission line 34, input processing of a destination floor registration signal originating from a destination floor registration device 43 installed at the elevator hall, and output processing of the car allocation signal and a destination floor registration light signal in response to the destination floor registration signal originating from the group management control unit 1. Note that, in this example the elevator hall display control unit 7 handles the destination floor registration information and the destination floor registration light information and the like, of the three elevators controlled by the respective car control units 2–4.

An elevator hall display device 42 installed on each floor performs display control of a display and the like of serial numbers of cars actually allocated, based on the car allocation signal originating from the elevator hall display control unit 7.

The destination floor registration device 43 installed on each floor performs input processing of an ON/OFF contact point signal originating from the destination registration button, and control of actual turning on and turning off of the light based on the destination registration light signal originating from the elevator hall display control unit 7.

Further, in FIG. 1 the expansion control unit 8 has the communications device 10 and an expansion control device 20H. This expansion control unit 8 is mutually joined with another network via a transmission line 35, and performs a bridge function for joining with another group management communications control system. Further, the expansion control unit 8 is connected via the transmission line 35 to a personal computer installed in a management room, and this personal computer monitors a plurality of elevator group management communications control systems established throughout the building.

Note that, the series A in FIG. 1 indicates an elevator hall registration signal and an elevator hall registration light signal being, for example, for general use (non-handicapped passengers), and the series B indicates the same being, for example, for handicapped passengers. Further, a series a indicates destination floor registration information, for example, being for use for a specific floor.

In the explanation provided hereinafter, the communications devices 10 of each of the control units 20A–H are referred to as "nodes". The node for performing processing relating to transmitting/receiving of network is referred to as the "network master node" (abbreviated as the "master"), and only one such node is allowed to exist at given time. All the other nodes which are not masters are referred to as "network slave nodes" (abbreviated as "slaves").

As for discernment between master and slaves, there are instances when the control unit corresponding to the master is the group management control unit 1, and there are also instances when it is the elevator hall registration control unit 5. Thus, discernment between master and slaves is determined by the length of the logical network address (i.e., comparison of priority levels) set in advance in the network address management table.

Next, FIG. 2 is a diagram showing this network address management table.

This table is for establishing correspondences between an "Alive/Dead Identifier", "Master/Slave", "Position", "Node Number", "Logical Network Address" and "Physical Network Address". This table is stored, for example, in advance in the communications device 10 in FIG. 1 showing the construction of the communications control system for elevators.

In other words, the communications control system for elevators according to Embodiment 1 of the present invention is a communications control system for elevators having plurality of control units for controlling elevators including the respective car control units and the elevator hall registration control units, each of said plurality of control units having a node, the plurality of nodes being connected to each other via a network, and each of said node having the management table shown in FIG. 2 establishing correspondence between the node number and the network address, said elevator communications control system comprising;

a node acting as a master when, in the case where a first network address corresponding to the node number of this node is, upon referring to the management table, a specific address having high priority level in the management table, this node sends to all other nodes a broadcast communication to notify that this node is a temporary master having the first network address added thereto and receives from another temporary master a broadcast communication for notifying that this other node is the temporary master having a second network address corresponding to the node number of this other temporary master added thereto, if the first network address and the second network address conform to specific conditions (priority level); and a node acting as a slave when, in a case where the network address corresponding to the node number of this node is not a specific address in the management table or the first network address corresponding to the node number of this node is a specific address in the management table upon referring to the management table, this node sends to all other nodes a broadcast communication to notify that this node is a temporary master having the first network address added thereto and receives from another temporary master a broadcast communication for notifying that this other node is the temporary master having a second network address corresponding to the node number of this other temporary master added thereto, if the first network address and the second network address do not conform to specific conditions.

Next, explanation is made of operations of the communications control system for elevators according to Embodiment 1 of the present invention, making reference to the drawings.

Figure 3:
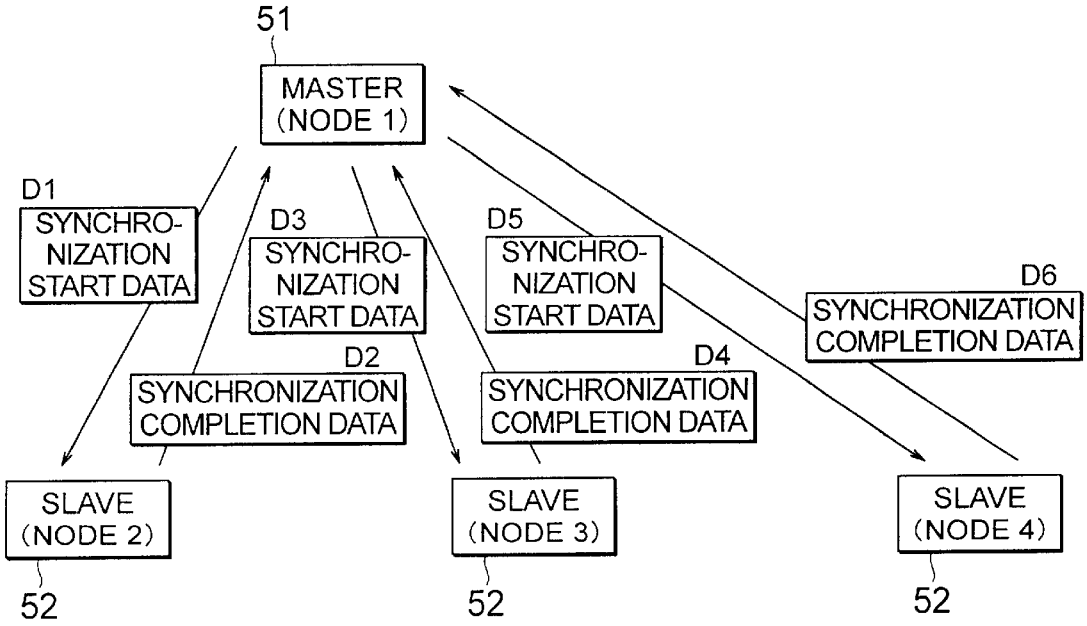
FIG. 3 is a diagram showing the construction of the communications control device according to Embodiment 1 of the present invention.

FIG. 3 shows the connections of FIG. 1 in a simplified fashion.

As shown in FIG. 3, when a master (node 1) transmits synchronization start data to a slave (node 2), after the slave (node 2) sends its own data, it then sends synchronization completion data D2 to the master (node 1). After the master sends data stored in a sending buffer up until the time when synchronization completion data was received, the master then sends synchronization start data D3 to a slave (node 3). The master then sequentially performs sending and receiving of synchronization start/completion data with a subsequent slave. Note that, D4 and D6 indicate the synchronization completion data and D5 indicates the synchronization start data.

Figure 4:
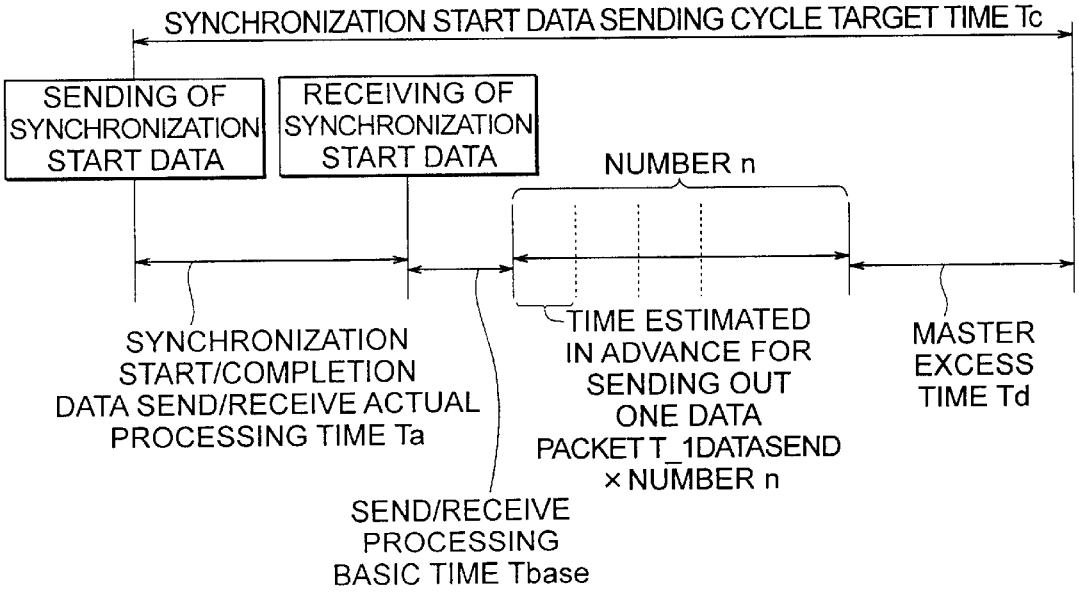
FIG. 4 is a diagram showing data communication timing according to Embodiment 1 of the present invention.

At this time, as shown in FIG. 4, the interval at the master between the time when the synchronization start data is sent and the synchronization completion data is received is referred to as a synchronization start/completion data send/receive real processing time Ta. Assuming that the time estimated in advance for sending out one data packet from the master is T_1datasend, a time required for sending data Tb can be calculated from this T_1datasend and the number of sent data that had been stored in the sending buffer until the time when the synchronization completion data was received. The basic time that is spent in the case when there is not any data to be sent is a send/receive processing basic time Tbase. Further, a synchronization start data sending cycle target time is Tc.

The master (node 1) sends the synchronization start data according to the following terms.

In the case when the sum of the synchronization start/completion data send/receive real processing time Ta, the time required for sending data Tb and the send/receive processing basic time Tbase is greater than the synchronization start data sending cycle target time Tc, the master completes the data sending processing and then quickly sends the synchronization start data to the subsequent slave node.

In the case when the sum of the synchronization start/completion data send/receive real processing time Ta, the time required for sending Tb and the send/receive processing basic time Tbase is less than the synchronization start data sending cycle target time Tc, the difference between this sum and the Tc is considered as a master excess time Td, and the timing for sending the synchronization start data to the subsequent slave node is delayed for an amount of time equivalent to the master excess time Td, and the synchronization start data sending cycle is adjusted so as to be the same as the target time.

Figure 5:
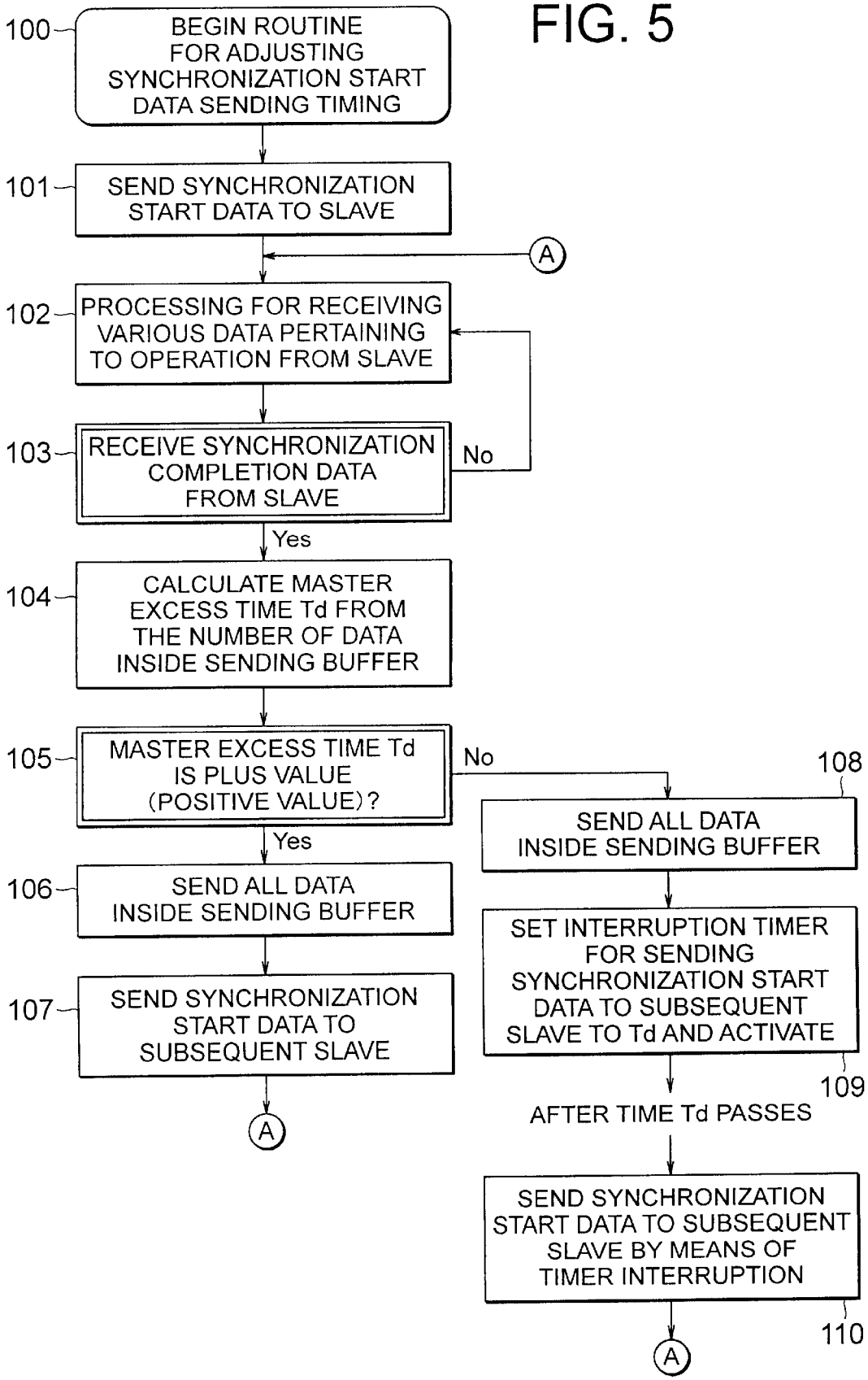
FIG. 5 is a flow chart showing a synchronization start data transmission timing according to Embodiment 1 of the present invention.

FIG. 5 is a flow chart showing content of processing of a routine for adjusting the timing of sending the synchronization start data.

The master first, at step 101, sends the synchronization start data to the slave. At step 102 the master receives various kinds of operation data from the slave. At step 103 the synchronization completion data is received from the slave, and at step 104 a data send time is calculated from the product of the time estimated in advance to be necessary for sending processing of one packet T_1datasend and the number n of data packets that the master has already completed the preparation for sending. The sum of this product plus send/receive processing time for the synchronization start/completion data from the slave Tb and the send/receive processing basic time Tbase that is spent even when there is no data to be sent is subtracted from the synchronization start data sending cycle target time is Tc, and the master excess time Td is calculated by the following equation:

$$Td=Tc-(Tbase+Tb+T_1datasend\times n)$$

At step 105, when the master excess time Td is a positive value there is an excess of time compared to the synchronization start data sending cycle target time. Therefore, after all the sending of the data inside the sending buffer at step 108, the excess time Td remaining until synchronization start data is sent to the subsequent slave is set on an interrupt timer at step 109. After the time Td passes, at step 110 the synchronization start data is sent to the subsequent slave, and the process transits to step 102. Further, at step 105, when the master excess time Td is a minus value there is not an excess of time compared to the synchronization start data sending cycle target time. Therefore, after all the sending of the data inside the sending buffer at step 106, the synchronization start data is sent to the subsequent slave at step 107 without a lapse of time, and then the processing transits to step 102.

Here, there may be a case in which the master excess time Td is a positive value and there is the excess of time compared to the synchronization start data sending cycle target time, but nevertheless, the synchronization start data is sent to the subsequent slave immediately after the all the sending of the data inside the sending buffer is completed. In this case, the proportion that the synchronization start/completion data occupies relative to the data pertaining to operation that is originally desired to be sent and received becomes great, and the network load on both the master and slave increases. This problem is solved by performing controls such that the sending and receiving of the synchronization start/completion data is conducted according to the synchronization start data sending cycle target time Tc.

Embodiment 2

Next, explanation is made of operations of a communications control system for elevators according to Embodiment 2 of the present invention, making reference to the drawings.

The communications control system for elevators according to Embodiment 2 of the present invention also has a construction having the connection shown in FIG. 1 similar to Embodiment 1, and essential operations such as the operation for deciding the master and synchronization communications are the same as those in Embodiment 1.

Figure 6:
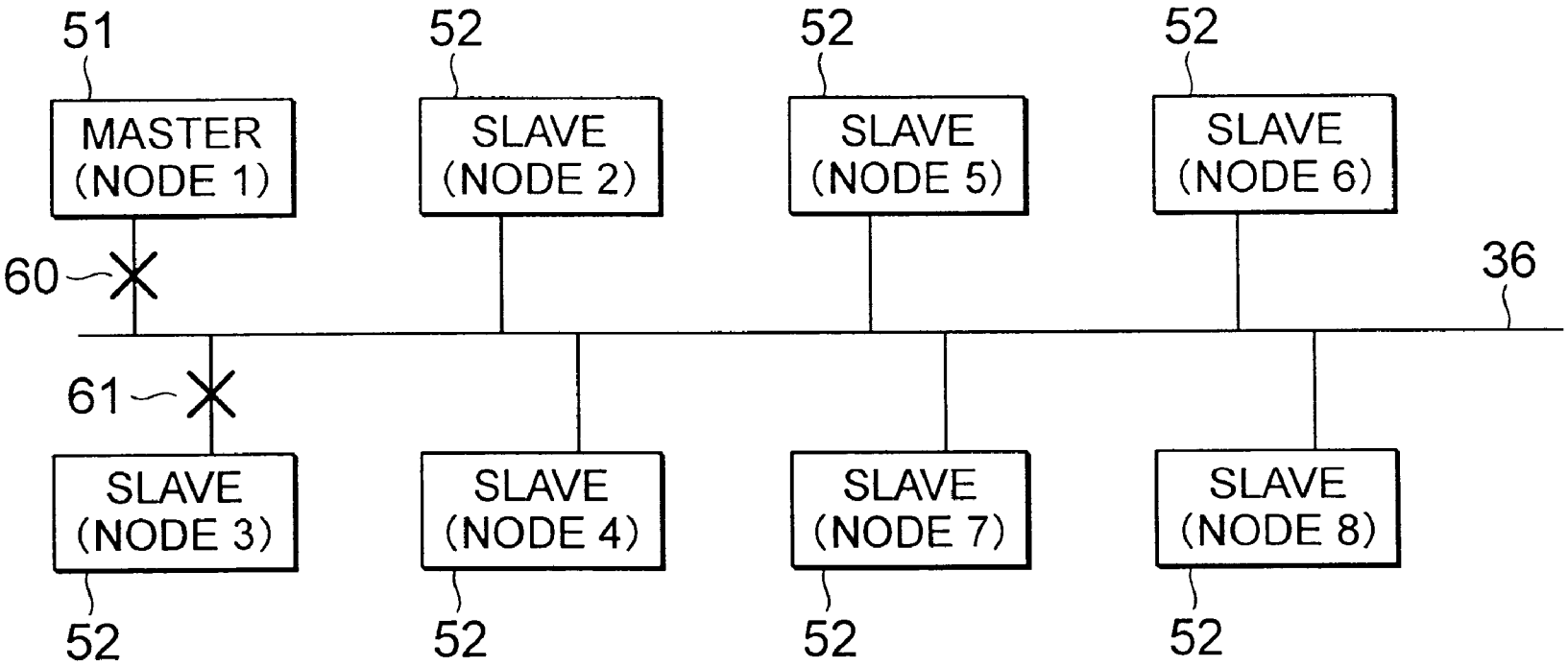
FIG. 6 is a diagram showing the construction of the communications control device according to Embodiment 2 of the present invention.

FIG. 6 is a diagram showing, in an abbreviated fashion, the master node/slave node construction shown in FIG. 1. One master 51 and seven slaves 52 are connected to the same transmission channel 36. Explanation of the processing is made referring to master 1 and slave 3 in the same diagram.

First, explanation is made of operations of the master (node 1).

Figure 7:
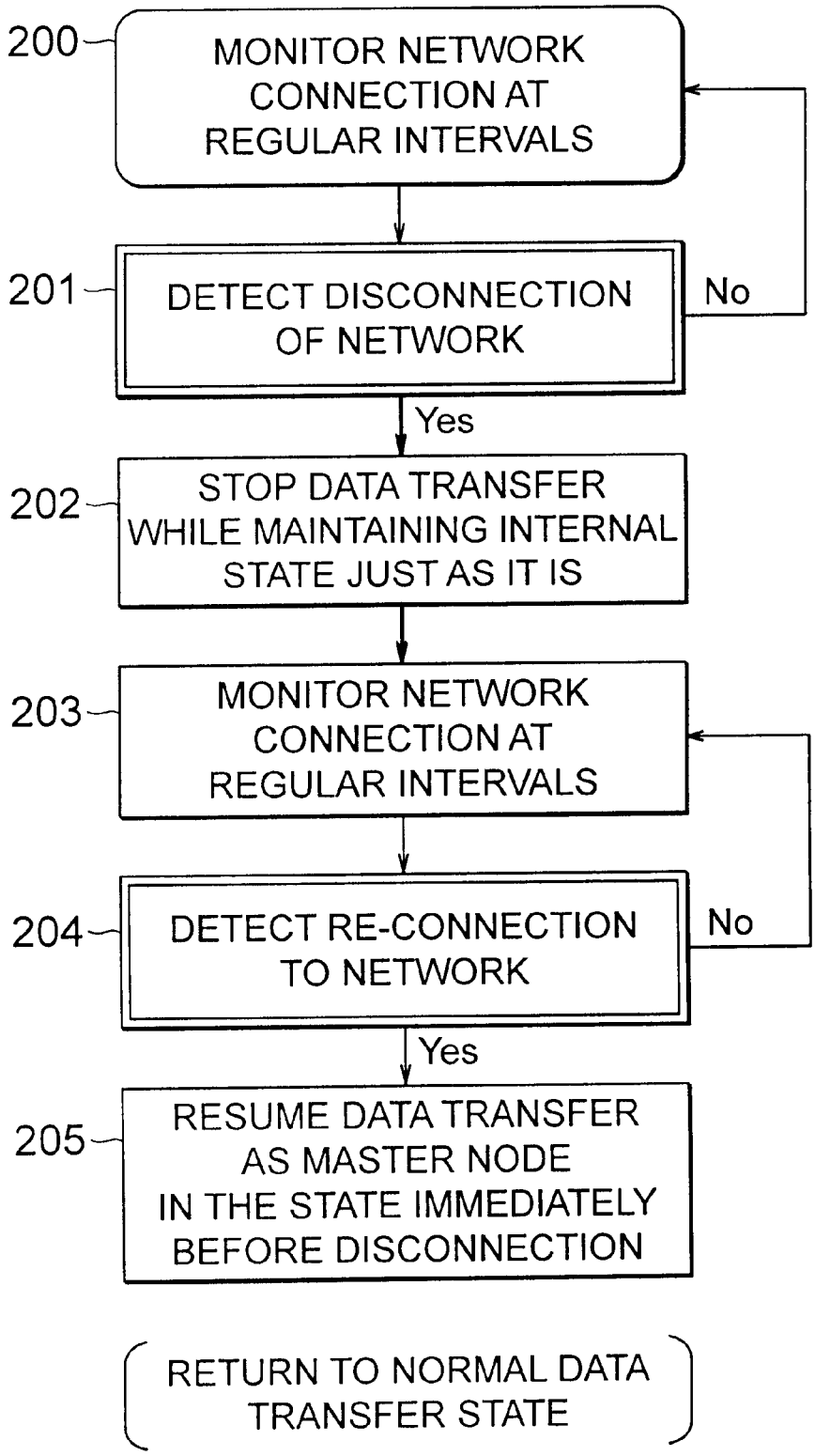
FIG. 7 is a flow chart showing an operation of a master at a time when a transmission channel is severed, according to Embodiment 2 of the present invention.

At step 200 of the flow chart shown in FIG. 7, each node monitors at fixed intervals the connection to the network. Specifically, the communications device 10 shown in FIG. 1 monitors the connection electrically. Assuming that a network disconnection (reference numeral 60 shown in FIG. 6) occurs due to some cause, the master (node 1) detects at step 201 that the connection to the network is electrically severed.

At step 202, the master (node 1) stops the transfer of data taking place via the network while maintaining the internal state just as it is. At step 203, the master (node 1) monitors the network again and waits for the connection to be reopened. At step 204, when an failure is removed and the master (node 1) detects a re-connection to the network, the master (node 1) resumes data transfer at step 205 in the very state as immediately before stopping the data transfer. That is, as the only master node on the network, the master (node 1) performs management of the data transfer and operates such that the operations of the network are smoothly resumed.

In this way, the internal state is maintained even when the network connection is severed, and when the connection is reopened it is possible to enter the network in the same state as immediately before the connection is severed, producing the result that delays due to restoration are suppressed as much as possible, and a network is formed being strong in restoration of failure.

Figure 8:
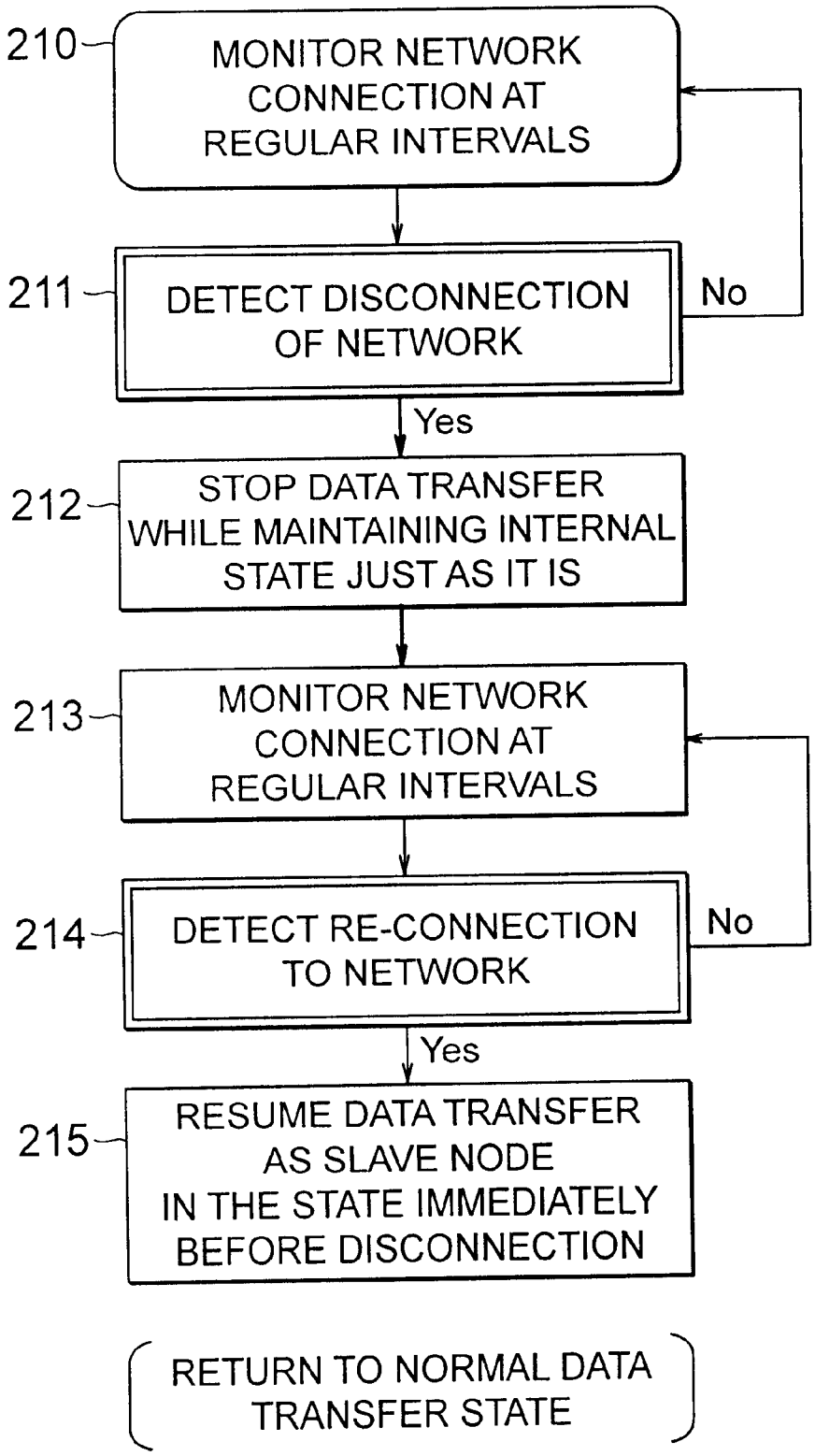
FIG. 8 is a flow chart of an operation of a slave at the time when the transmission channel is severed, according to the Embodiment 2 of the present invention.

Next, explanation is made of operations of the slave (node 3). At step 210 in the flow chart shown in FIG. 8, the slave node monitors at regular intervals the connection to the network. Assuming that a network disconnection (reference numeral 61 shown in FIG. 6) occurs due to some cause, the slave (node 3) detects at step 211 that the connection to the network is electrically severed.

At step 212, the slave (node 3) stops the forwarding of data taking place via the network, maintaining the internal state just as it is. At step 213, the slave (node 3) monitors the network again and waits for the connection to be reopened. At step 214, when an failure is removed and the slave (node 3) detects a re-connection to the network, the slave (node 3) resumes data transfer at step 215 in the very state as immediately before stopping the data transfer. That is, in the management section of the master node on the network, the slave (node 3) performs management of the data transfer as a slave node and operates such that the operations of the network are smoothly resumed.

In this way, at the slave node too, the internal state is maintained even when the network connection is severed, and when the connection is reopened it is possible to enter the network in the same state as immediately before the connection severed, producing the result that delays due to restoration are suppressed as much as possible, and a network is formed being strong in restoration of failure.

Figure 9:
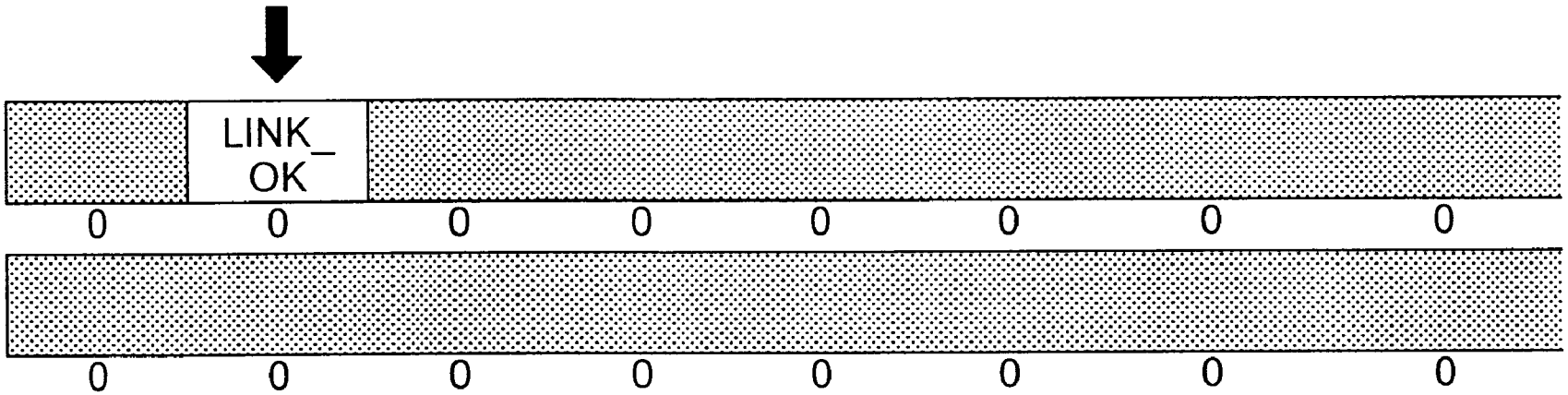
FIG. 9 is a diagram showing a register map of the communications control device according to Embodiments 2 to 4 of the present invention.

Explanation is made of electrical connection monitoring in the case when a communications control IC (LAN91C96) provided by Standard Microsystems Corporation, for example, is used as a communications device. This communications control IC (LAN91C96) has a register map shown in FIG. 9, and a LINK_OK register in this register map has a function for showing a result of an electrical network connection check. Specifically, when a communications control IC (LAN91C96) being used as the communications device is physically connected to the transmission channel 31 shown in FIG. 1, the communications control IC (LAN91C96) confirms this connected state, and sets the LINK_OK register to "1". On the other hand, when the physical connection to the transmission channel 31 is severed, the communications control IC (LAN91C96) confirms this severed condition and sets the LINK_OK register to "0". As a result, as the communications device, the communications control IC (LAN91C96) checks this LINK_OK register and determines the connection to or the severance from the network. Further, it is also possible to use another IC having comparable functions.

Figure 10:
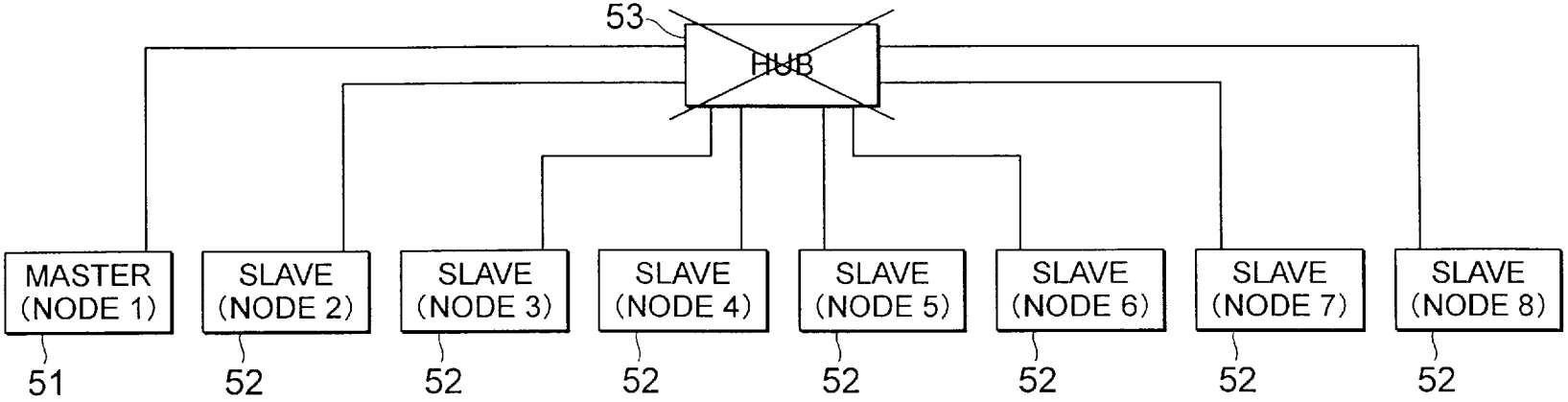
FIG. 10 is a diagram showing the construction of the communications control device according to Embodiment 2 of the present invention.

It can be easily presumed that the network severance causes the hub for realizing the connections of the plurality of nodes on the network to fail, as shown in FIG. 10. In the case when failure occurs at a hub 53 and the network is severed at the position of the hub, from the point of view of all the nodes connected to the hub it is seen as though the network is electrically severed. At this time, according to the procedure addressed above, the each master node/slave node maintains its own operations state, and when the network failure has been restored, the master node/slave nodes reconstitute as much as possible their states immediately before the occurrence of the failure, and thus the failure restoration can be performed extremely smoothly.

Embodiment 3

Next, explanation is made of operations of the communications control system for elevators according to Embodiment 3 of the present invention.

The communications control system for elevators according to Embodiment 3 of the present invention also has a construction having the connection shown in FIG. 1 similar to Embodiment 1, and essential operations such as the operation for deciding the master and synchronization communications are the same as Embodiment 1. Further, the operations of the master node/slave node are the same as those of the communications control system for elevators according to Embodiment 2.

Figure 11:
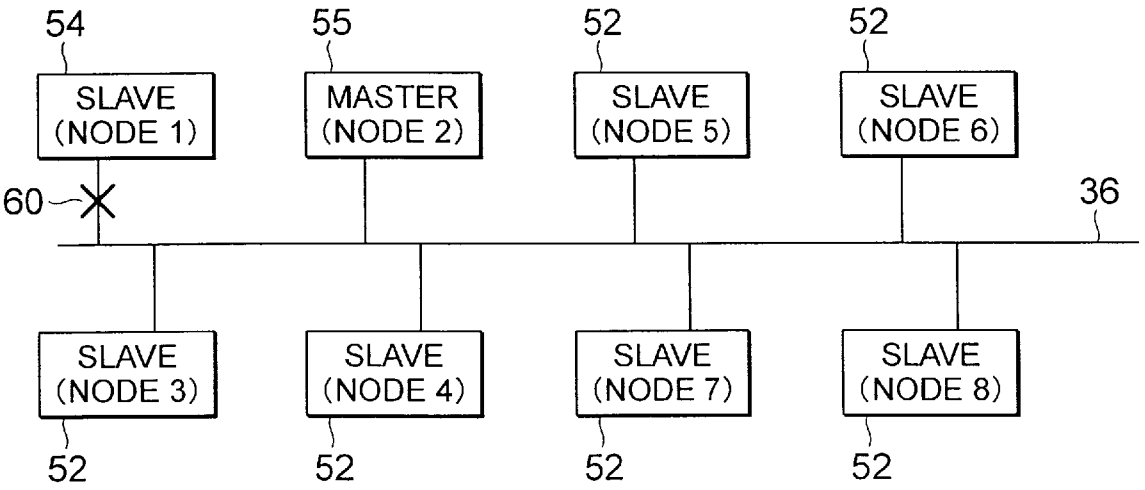
FIG. 11 is a diagram showing a construction of the communications control device according to Embodiment 3 of the present invention.

FIG. 11 is a diagram showing, in an abbreviated fashion, the master node/slave node construction shown in FIG. 1. One master 55, one slave 54, and seven slaves 52 are connected to the same transmission channel 36.

Node 1 in the same diagram is a node acting as a master when, in the case where a first network address corresponding to the node number of this node is, upon referring to the management table, a specific address in the management table, this node sends to all other nodes a broadcast communication to notify that this node is a temporary master having the first network address added thereto and receives from another temporary master a broadcast communication for notifying that this other node is the temporary master having a second network address corresponding to the node number of this other temporary master added thereto, if the first network address and the second network address conform to specific conditions.

Explanation is made of operations of the node that acts as the master.

Figure 12:
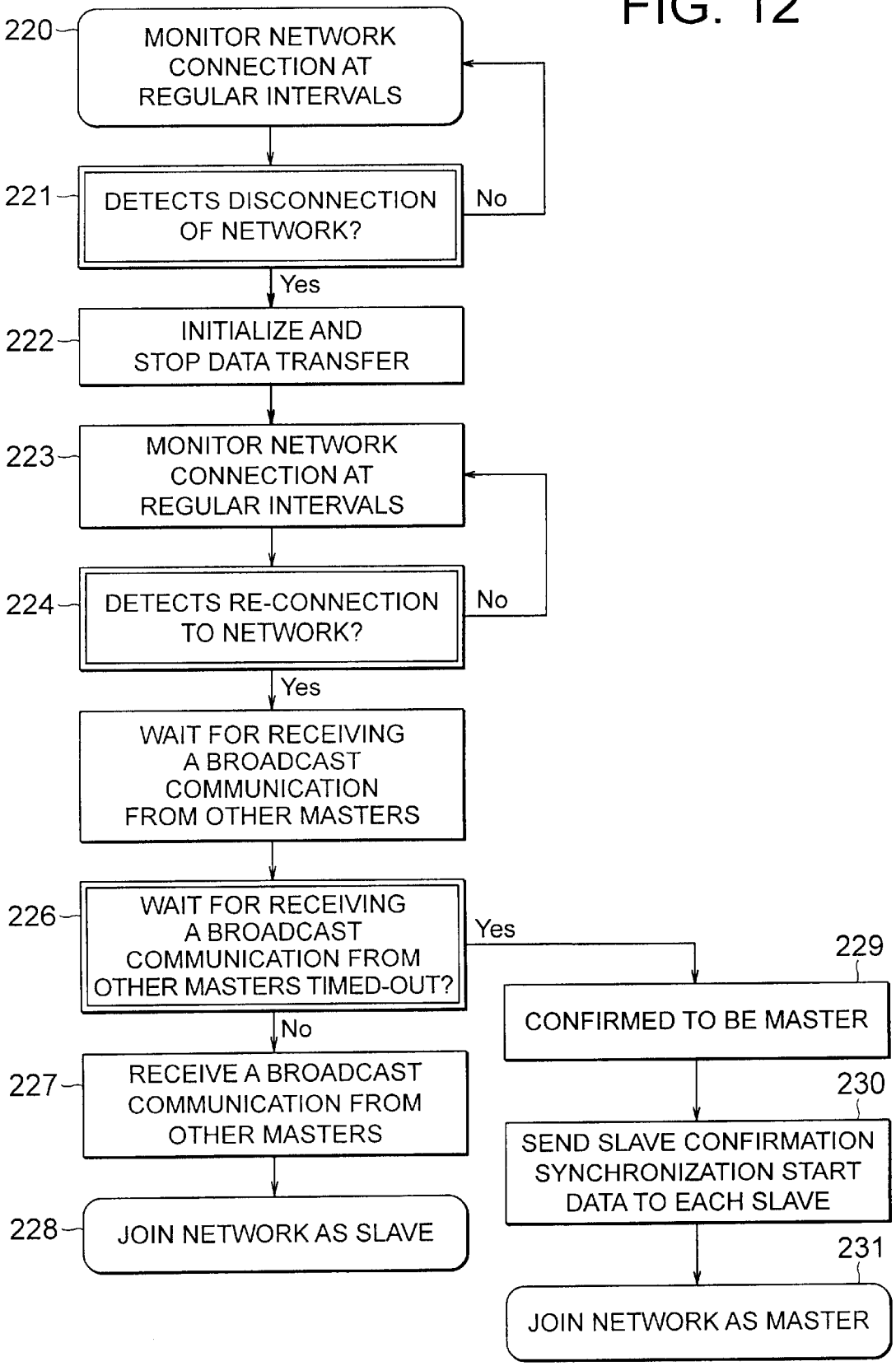
FIG. 12 is a flow chart of an operation of the master at a time when the communications channel is severed, according to Embodiment 3 of the present invention.

It is assumed here that at step 220 in the flow chart shown in FIG. 12, this node is monitoring a network connection at regular intervals. Specifically, the communications device 10 shown in FIG. 1 electrically monitors the connection. Assuming that a network disconnection (reference numeral 60 shown in FIG. 11) occurs due to some cause, the node 1 detects at step 221 that the connection to the network is electrically severed.

At step 222, the node 1 initializes its internal state, stops the forwarding of data taking place via the network, and at step 223 monitors the network again and waits for the connection to be reopened. At step 224, when the failure is removed and the node 1 detects the reconnection to the network, the node 1 begins operations by entering the network anew.

As a result, at step 225 the node 1 enters a state of waiting to receive the a broadcast communication from other masters. In the case when a time-out occurs at step 226, that is, in the case when other masters do not exist, confirmation is made at step 229 that the node 1 is to operate as the master. At step 230 the node 1 sends slave confirmation synchronization start data to each slave, and at step 231 operates on the network as the master. Further, in the case when a time-out does not occur at step 226 and a simultaneous signal is received from other nodes at step 227, at step 228 the node 1 participates in the network as a slave.

In this way, there is provided a single node being capable of initializing itself and entering as a master even when a failure occurs such that there is no master on the network upon reopening of the severed connection. This produces the result that delays due to restoration are suppressed as much as possible, and a network is formed being strong in restoration of failure.

Explanation is made of electrical connection monitoring in the case when a communications control IC (LAN91C96) provided by Standard Microsystems Corporation, for example, is used as a communications device. This communications control IC (LAN91C96) has a register map shown in FIG. 2, and a LINK_OK register in this register map has a function for showing a result of an electrical network connection check. Specifically, when a communications control IC (LAN91C96) being used as the communications device is physically connected to the transmission channel 31 shown in FIG. 1, the communications control IC (LAN91C96) confirms this connected state, and sets the LINK_OK register to "1". On the other hand, when the physical connection to the transmission channel 31 is severed, the communications control IC (LAN91C96) confirms this severed condition and sets the LINK_OK register to "0". As a result, as the communications device, the communications control IC (LAN91C96) checks this LINK_OK register and determines the connection to or the severance from the network. Further, it is possible to use another IC having comparable functions.

Figure 13:
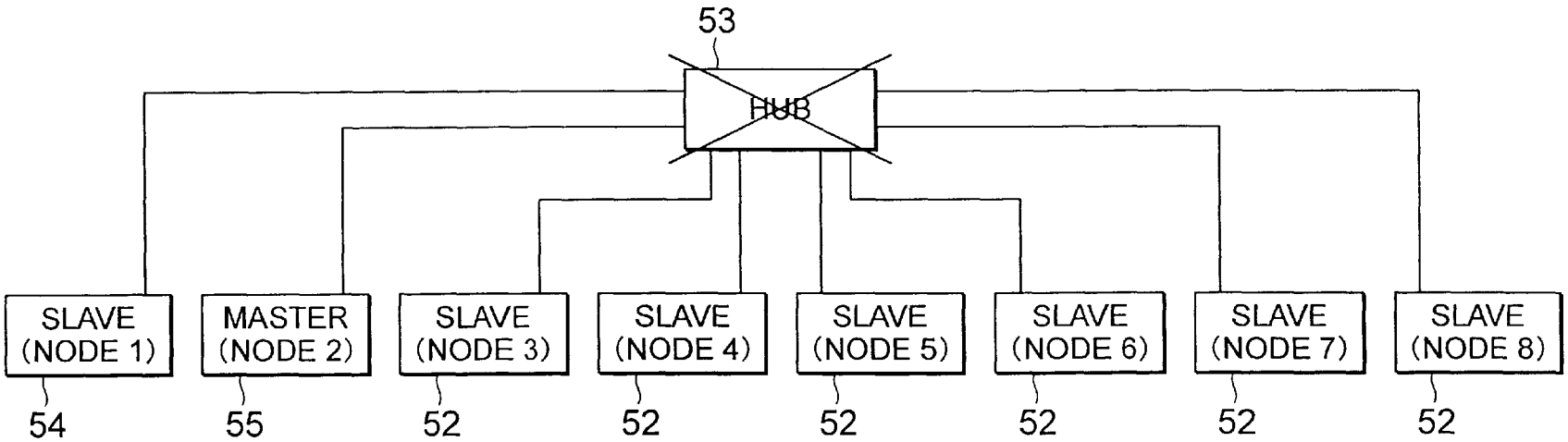
FIG. 13 is a diagram showing the construction of the communications control device according to Embodiment 3 of the present invention.

It can be easily presumed that the network severance causes the hub for realizing the connections of the plurality of nodes on the network to fail, as shown in FIG. 13. In the case when failure occurs at a hub and the network is severed at the position of the hub, from the point of view of the nodes connected to the hub it is seen as though the network is electrically severed. Further, when such a failure causes an occurrence of an operation failure in the node 3 operating as the master immediately before the failure occurrence, this can cause a state where no master exists after the hub failure is restored, which can become a cause of a network restoration delay.

At this time, according to the procedure addressed above, the node 1 is initialized and joins the network as a master, producing a result that the state immediately before the occurrence of the failure is reconstituted as much as possible, and the failure restoration can be performed extremely smoothly.

Embodiment 4

Next, explanation is made of operations of the communications control system for elevators according to Embodiment 4 of the present invention, making reference to the drawings.

The communications control system for elevators according to Embodiment 4 of the present invention also has a construction having the connection shown in FIG. 1 similar to those in Embodiment 1, and essential operations such as the operation for deciding the master and synchronization communications are the same as Embodiment 1. Further, the operations of the master node/slave node are the same as those of the communications control system for elevators according to Embodiment 2, 3.

Figure 14:
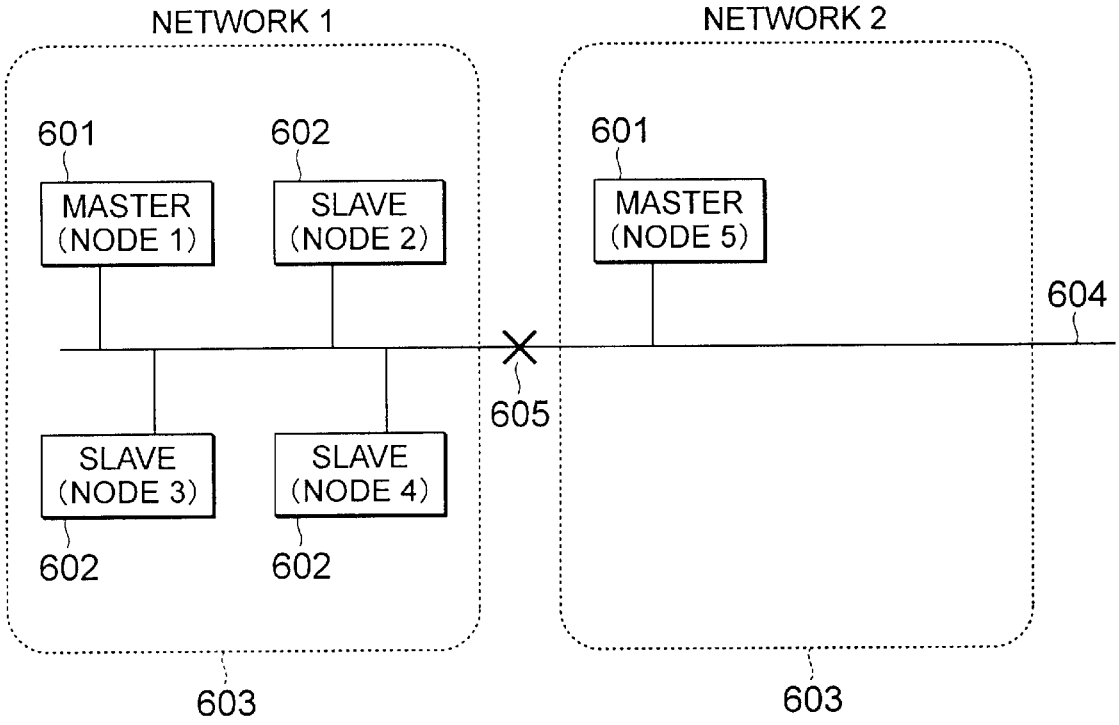
FIG. 14 is a diagram showing a construction of the communications control device according to Embodiment 4 of the present invention.

FIG. 14 is a diagram showing, in an abbreviated fashion, the master node/slave node construction shown in FIG. 1. Two masters 601 and three slaves 602 are connected to the same transmission channel 604.

In FIG. 14, the network is severed at a portion of a disconnected line 605, and two networks operate each having a respective master node. When the failure in the disconnected line 605 is restored, the two networks are connected and collide with each other. In order to operate as the original single network, one of the two master nodes switches to a slave node.

Explanation of this operation is made by explaining operations of a master (node 1) in FIG. 14.

Figure 15:
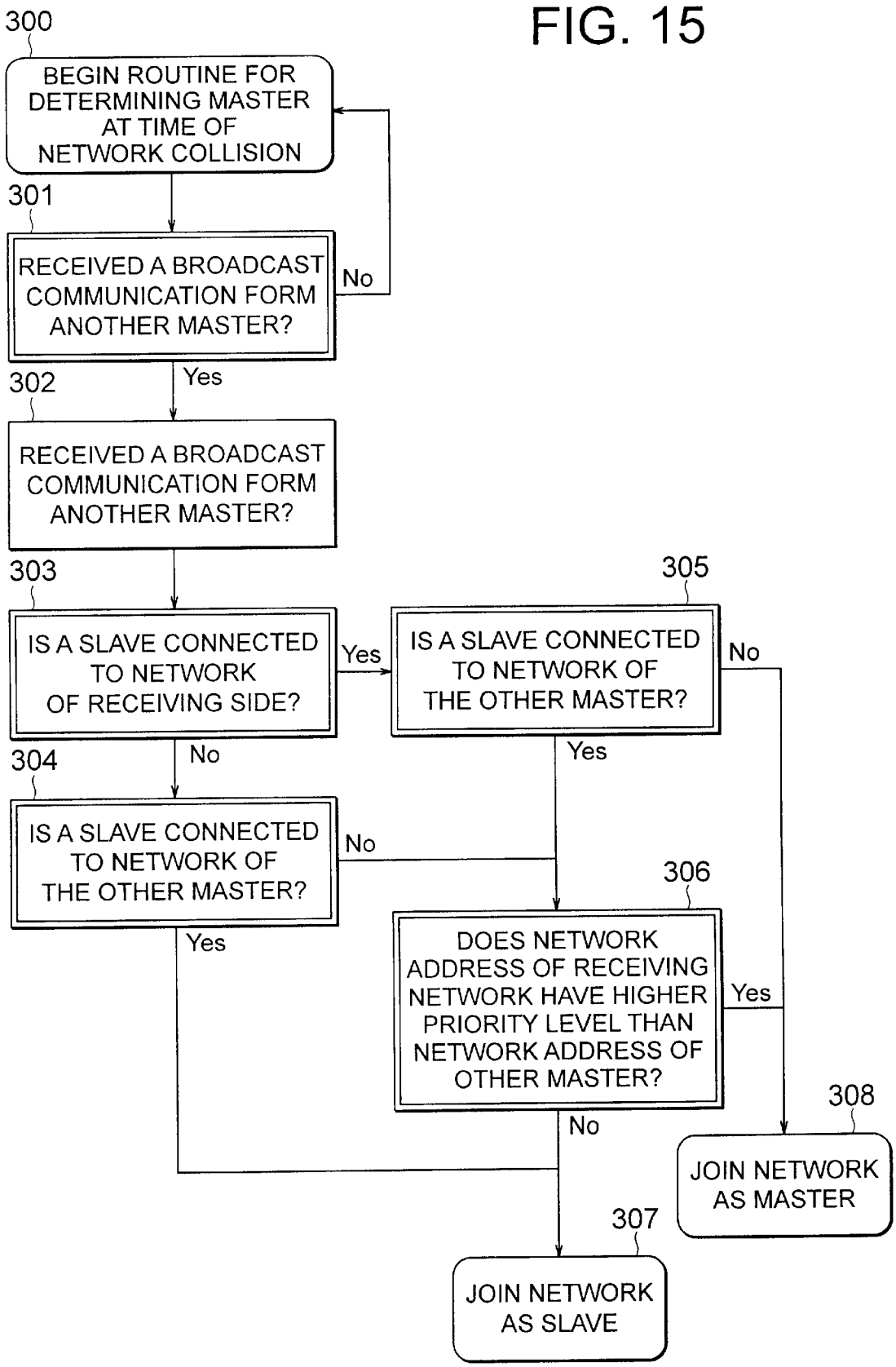
FIG. 15 is a flow chart showing an operation of the master at a time of network collision, according to Embodiment 4 of the present invention.

At step 301 of a flow chart shown in FIG. 15, a determination is made as to whether or not to receive a broadcast communication from another master. When the failure of the disconnected line 605 shown in FIG. 14 is restored, to receive a broadcast communication from the node 5 operating as the master in a network 2, the procedure transits to step 302. At step 303, a determination is made as to whether there exists a slave connected to the network receiving the a broadcast communication. At step 305, based on the a broadcast communication from the other master, a determination is made as to whether there exists a slave connected to the network of the other master. In the present example, no such slave exists, so at step 308 the node 1 becomes the network master and operates after the failure is restored.

Figure 16:
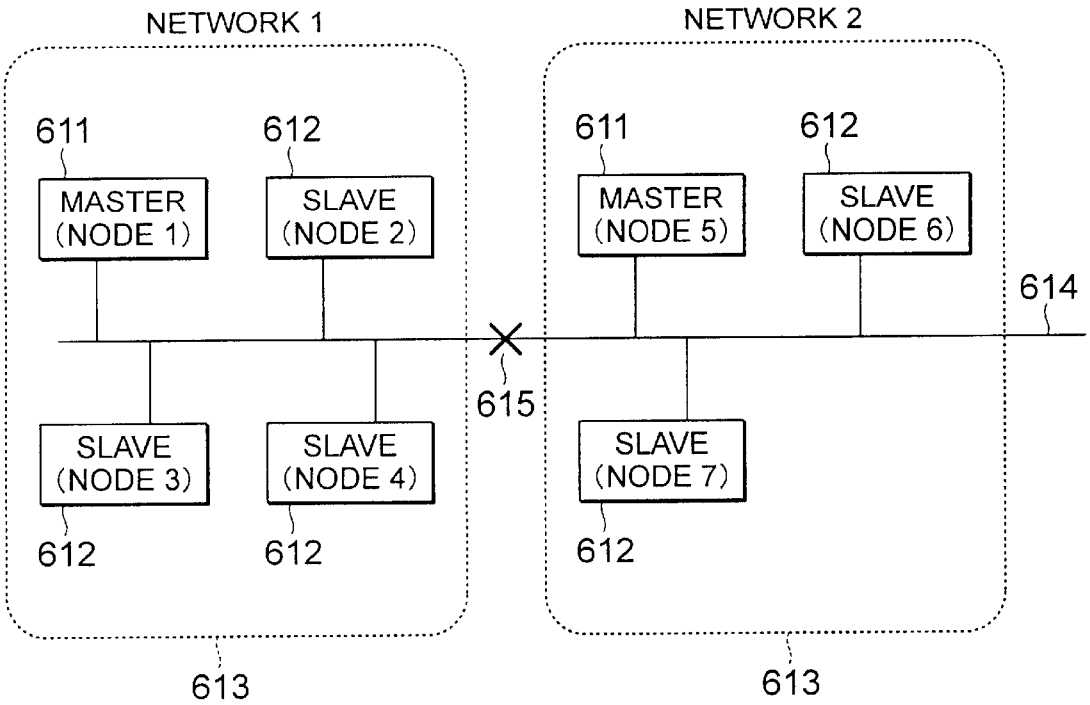
FIG. 16 is a diagram showing the construction of the communications control device, according to Embodiment 4 of the present invention.

Next, FIG. 16 is also a diagram showing, in an abbreviated fashion, the master node/slave node construction shown in FIG. 1.

In FIG. 16, the network is severed at a portion of a disconnected line 615, and two networks operate each having a respective master node. When the failure in the disconnected line 615 is restored, the two networks are connected and collide with each other. In order to operate as the original single network, one of the two master nodes switches to a slave node.

Explanation of this operation is made by explaining operations of a master (node 1) in FIG. 16.

First, at step 301 of a flow chart shown in FIG. 15, a determination is made as to whether or not to receive a broadcast communication from another master. When the failure in the disconnected line 615 shown in FIG. 16 is restored, to receive a broadcast communication from the node 5 operating as the master in a network 2, procedures transit to step 302. At step 303, a determination is made as to whether there exists a slave connected to the network receiving the a broadcast communication. At step 305, based on the a broadcast communication from the other master, a determination is made as to whether there exists a slave connected to the network of the other master. Since there is also a slave on the side of the other master, at step 306 a comparison is made based on the network addresses of the node 1 and the node 5 as to priority level as a master. In the present example the priority level of the node 1 is higher, so at step 308 the node 1 becomes the network master and operates after the failure is restored.

Figure 17:
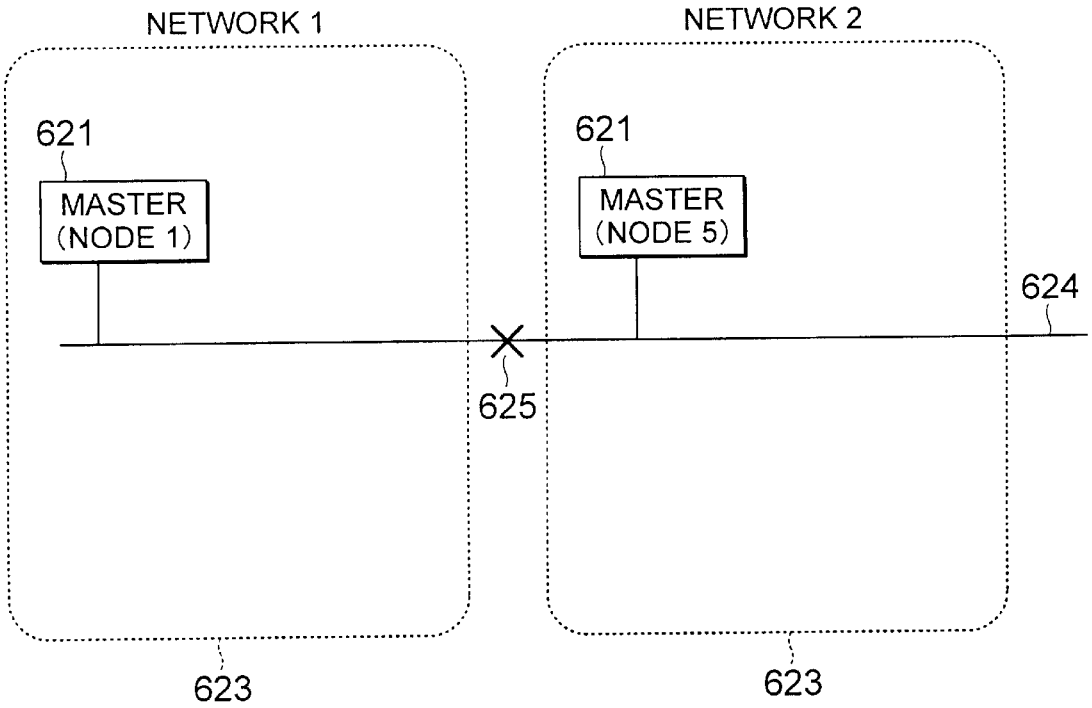
FIG. 17 is a diagram showing the construction of the communications control device, according to Embodiment 4 of the present invention.

Next, FIG. 17 is also a diagram showing, in an abbreviated fashion, the master node/slave node construction shown in FIG. 1.

In FIG. 17, the network is severed at a portion of a disconnected line 625, and two networks operate each having a respective master node. When the failure in the disconnected line 625 is restored, the two networks are connected and collide with each other. In order to operate as the original single network, one of the two master nodes switches to a slave node.

This operation is explained by the operations of a master (node 1) in FIG. 17.

First, at step 301 of a flow chart shown in FIG. 17, a determination is made as to whether or not to receive a broadcast communication from another master. When the failure in the disconnected line 625 shown in FIG. 17 is restored, to receive a broadcast communication from the node 5 operating as the master in a network 2, procedures transit to step 302. At step 303, a determination is made as to whether there exists a slave connected to the network receiving the a broadcast communication. At step 304, based on the a broadcast communication from the other master, a determination is made as to whether there exists a slave connected to the network of the other master. Since a slave is not present on the side of the other master either, at step 306 a comparison is made based on the network addresses of the node 1 and the node 5 as to priority level as a master. In the present example the priority level of the node 1 is higher, so at step 308 the node 1 becomes the network master and operates after the failure is restored.

As explained above, a compound condition of whether a slave node connected to the network exists and the priority levels of the network addresses, is used to select a single master node from two or more master nodes existing at the time of failure recovery, and failure restoration may be performed extremely smoothly.

Embodiment 5

Next, explanation is made of operations of the communications control system for elevators according to Embodiment 5 of the present invention, making reference to the drawings.

The communications control system for elevators according to Embodiment 5 of the present invention also has a construction having the connection shown in FIG. 1, and essential operations such as the operation for deciding the master and synchronization communications are the same as those in Embodiment 1. Further, the operations of the master node/slave node are the same as those of the communications control system for elevators according to Embodiment 2, 3 and 4.

Figure 18:
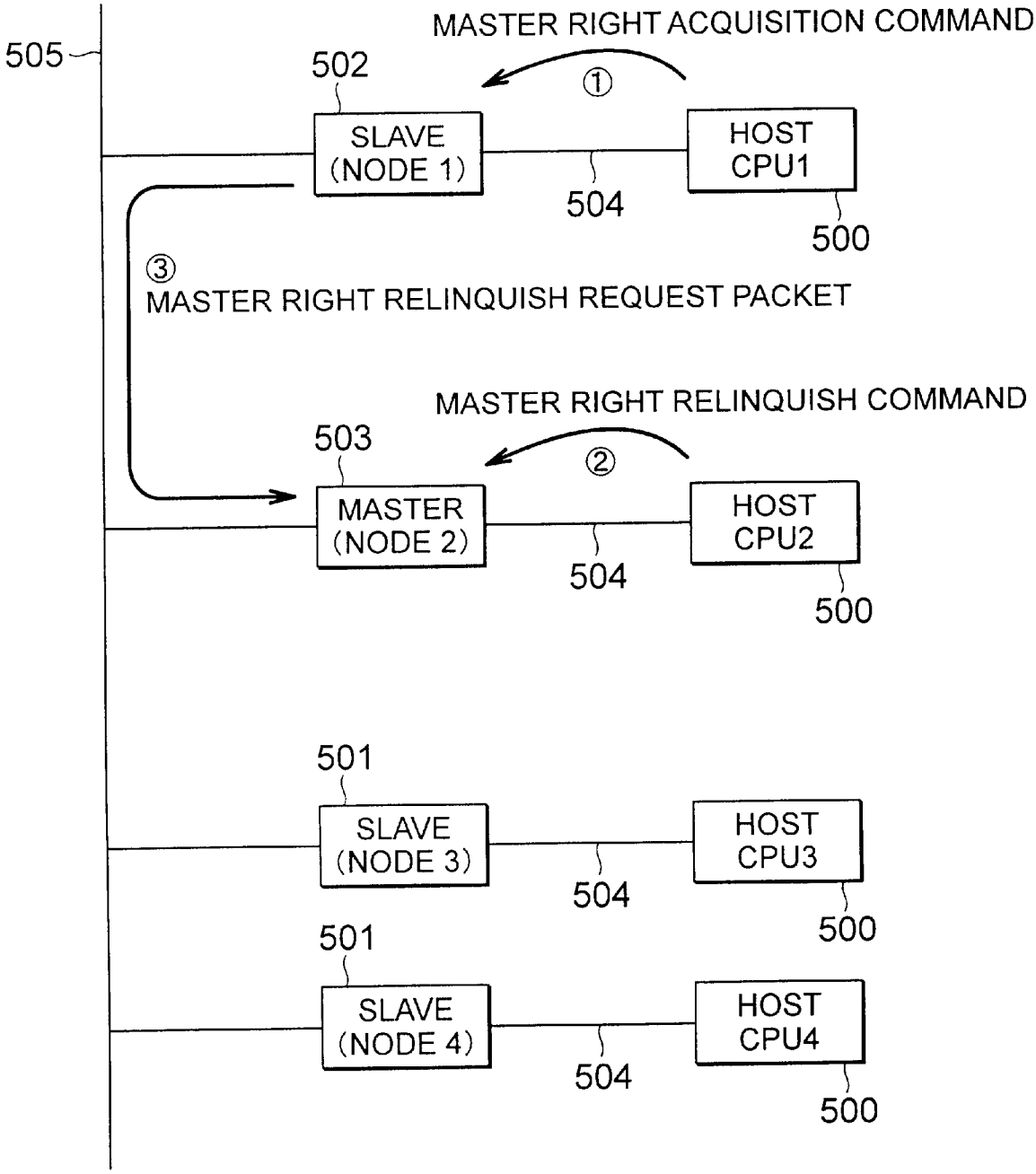
FIG. 18 is a diagram showing the construction of the communications control device, according to Embodiment 5 of the present invention.

FIG. 18 is a diagram showing, in an abbreviated fashion, the master node/slave node construction shown in FIG. 1. One master 503, two slaves 501 and one slave 502 are connected to the same transmission channel 505. Further, each node is connected to a host CPU via a transmission channel 504.

In FIG. 18 the node is operating as the master, and in this example the operation of moving the master right to the node 1 will be explained.

Figure 19:
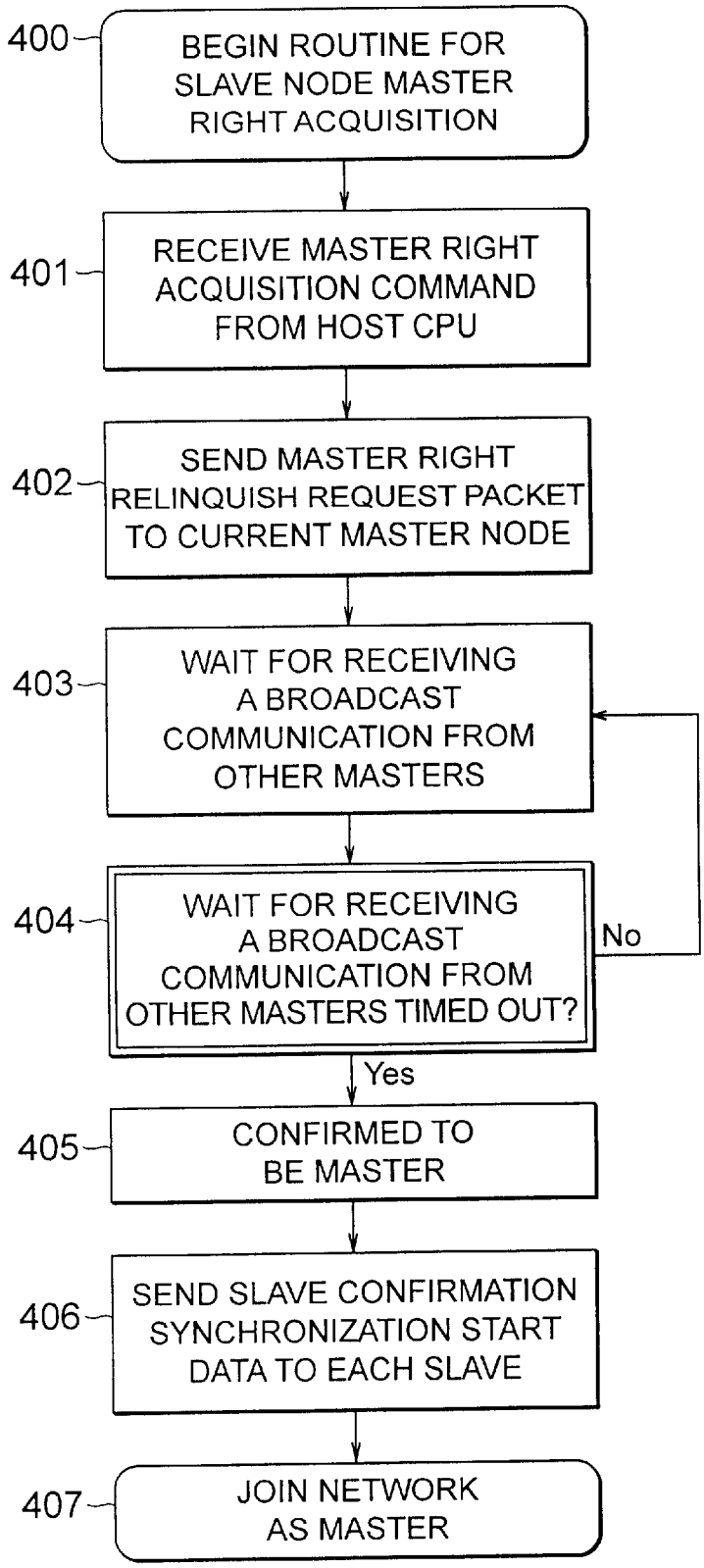
FIG. 19 is a flow chart showing a master right acquisition procedure of the slave node, according to Embodiment 5 of the present invention.

At step 401 of the flow chart shown in FIG. 19, the host CPU sends a command to the node 1 to acquire a D1 master right. At step 402, the node 1 sends a D2 master right relinquish request packet to the node 2 (master). At step 403, the node 1 waits for the time-out of the a broadcast communication sending from the node 2 (master) to occur. When at step 404 the time-out of the a broadcast communication sending from the node 2 (master) occurs, at step 405 the acquisition of the master right by the node 1 is confirmed, at step 406 the slave confirmation synchronization start data is sent to each slave, and at step 407, operation as the master begins.

Figure 20:
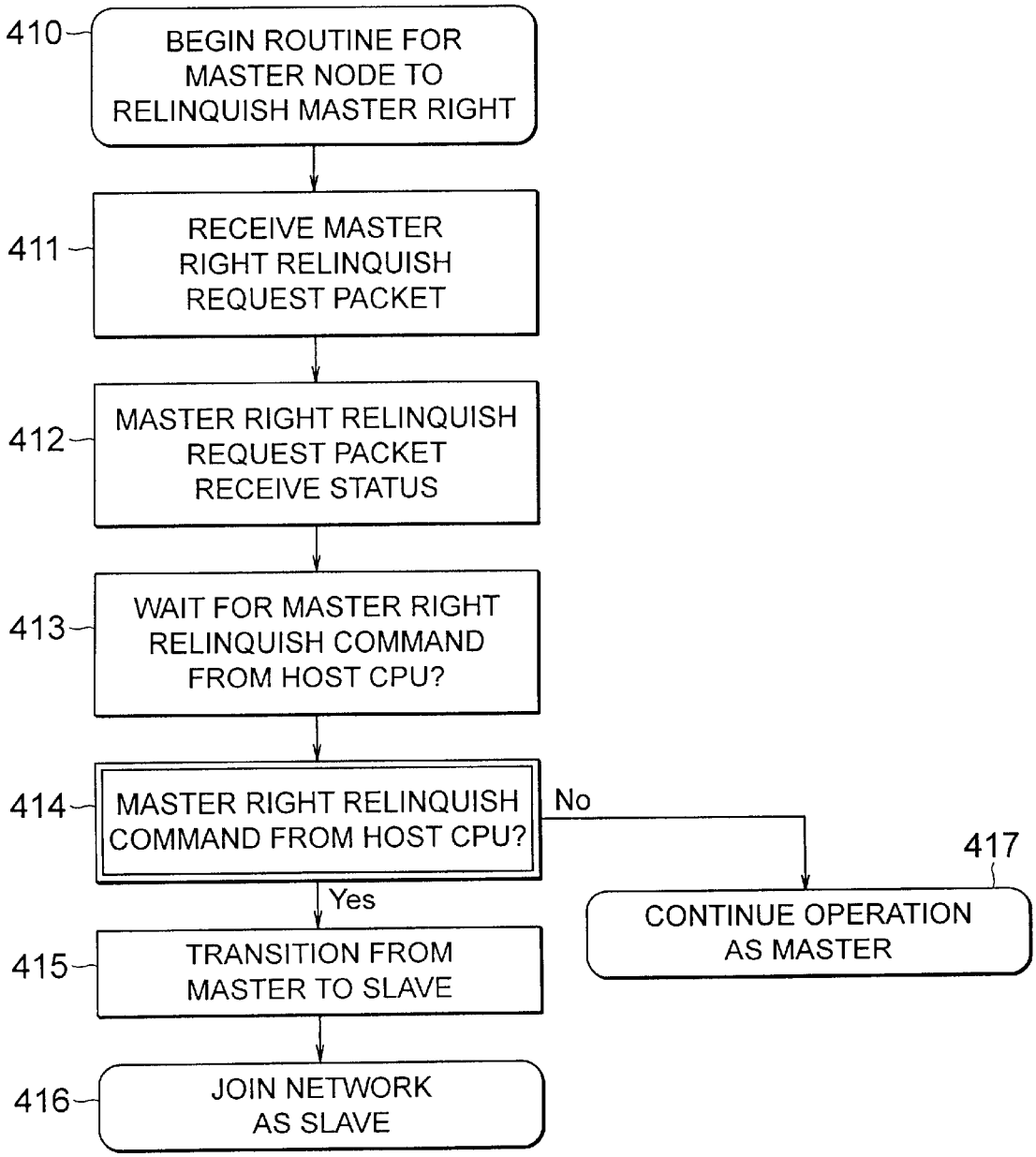
FIG. 20 is a flow chart showing a master right relinquishing procedure of the master node, according to Embodiment 5 of the present invention.
Figure 21:
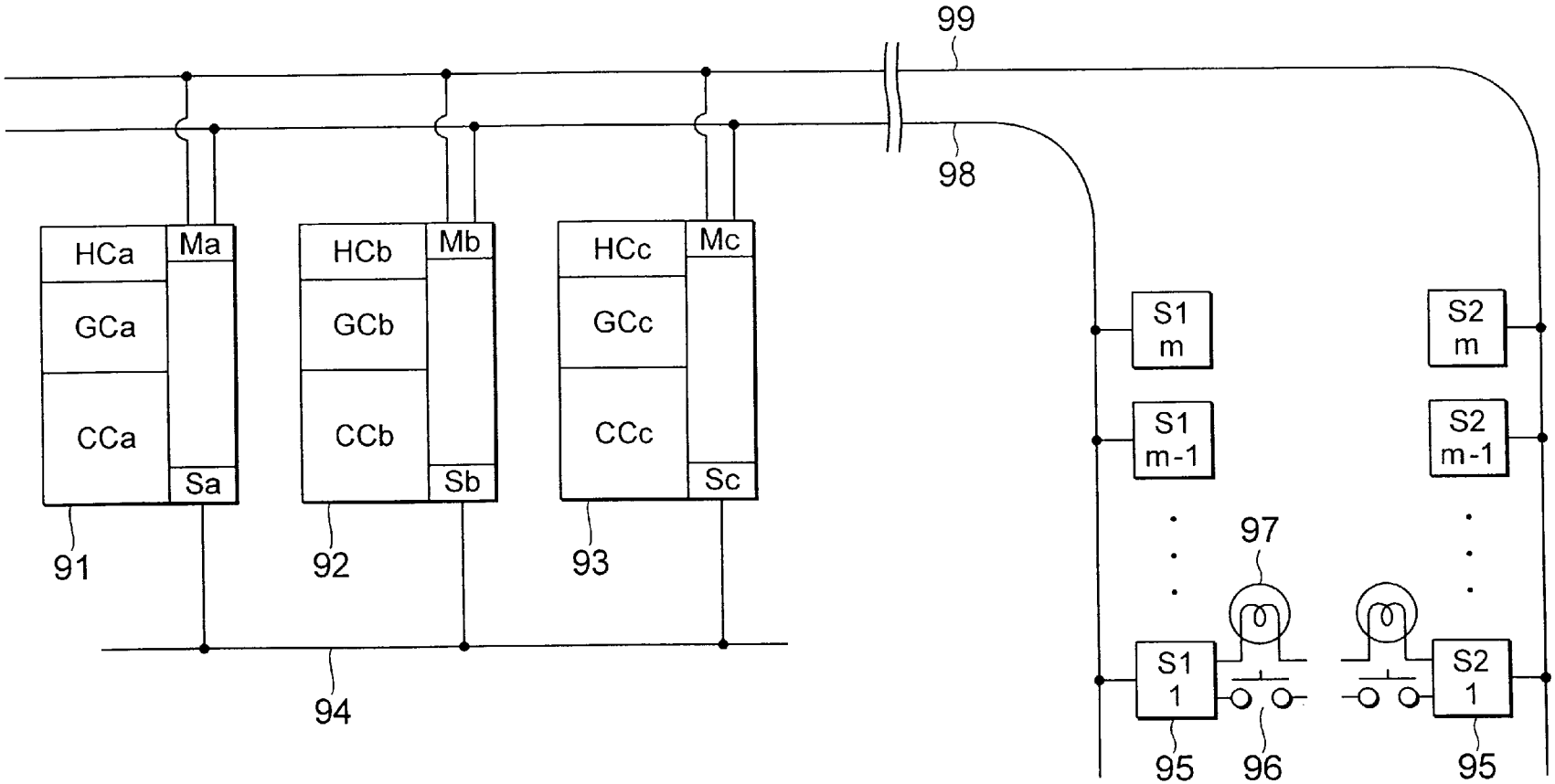
FIG. 21 is a diagram showing a construction of a conventional communications control system for elevators.
Figure 22:
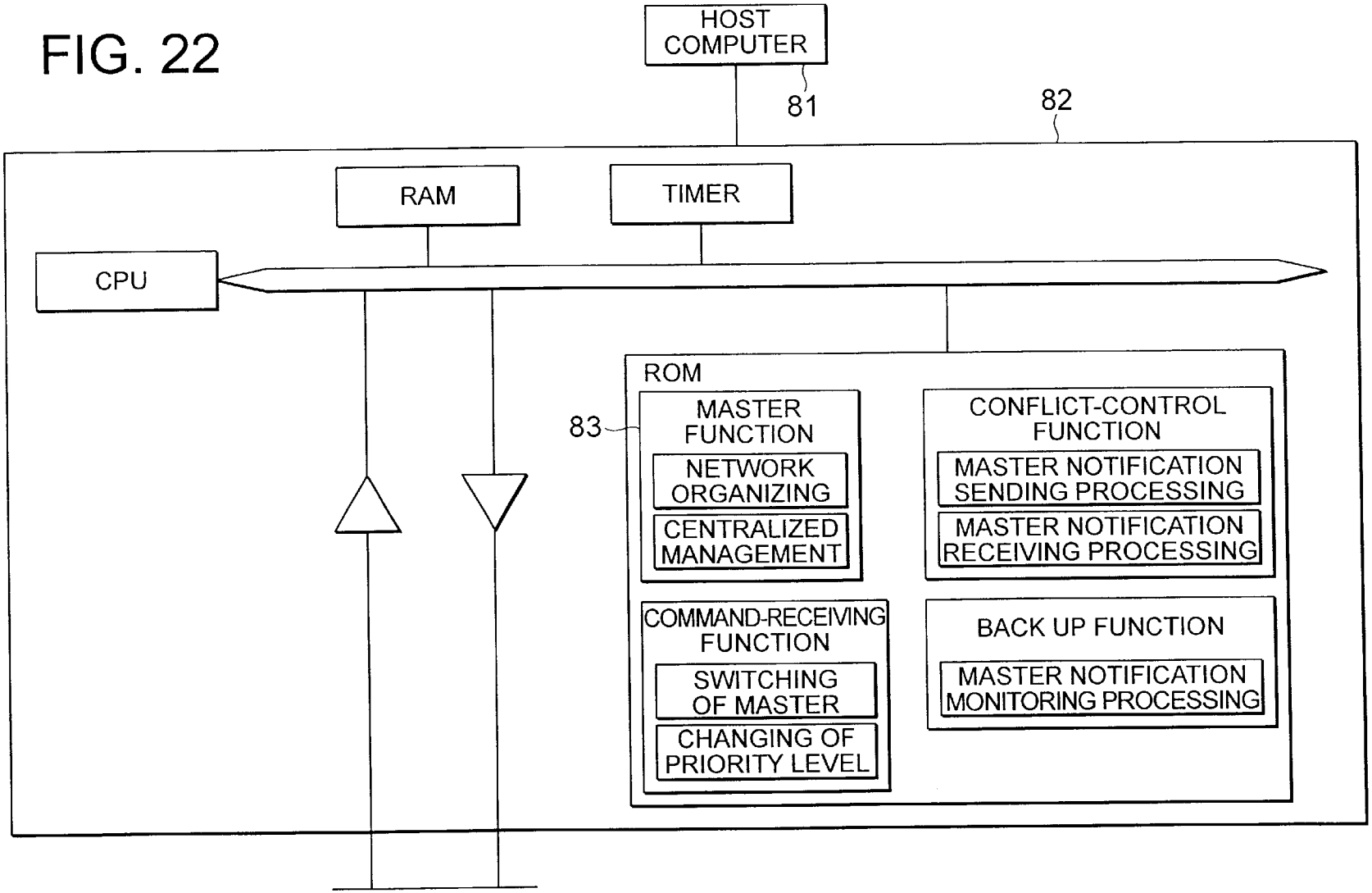
FIG. 22 is a diagram showing the construction of the conventional communications control device.

Further, at step 411 in the flow chart shown in FIG. 20, the node 2 receives the master right relinquish request packet from the node 1 (master). At step 412, the node 2 moves to a master right relinquish request packet receiving status. At step 413, the CPU 2 detects that the node 2 is in this master right relinquish request packet receiving status. When at step 414 the CPU 2 allows the relinquishing of the master right, a D3 master right relinquish command is sent to the node 2. At step 415, the node 2 relinquishes the master right and is demoted to slave. When at step 414 the CPU 2 does not allow the relinquishing of the master right, at step 417 the node 2 returns to normal status.

As explained above, in the movement of the master right, the intervention by the host CPU produces a result that the master right is prevented from moving without the recognition by the CPU, and stable operation of the network may be guaranteed.

As is explained above, according to the present invention, the master sends the synchronization start data to one slave from among the plurality of slaves; receives the synchronization completion data from the slave and sends the subsequent synchronization start data to the subsequent slave in order; and makes adjustments so that the synchronization start data sending timing matches the target cycle, assuming that the interval for sending the synchronization start data is the synchronization start data sending cycle, based on the following; the amount of time from the sending of the synchronization start data until the receiving of the synchronization completion data; the amount of time required for sending the data being calculable from the number of sending data stored in the sending buffer until the time of sending; and the target time for the synchronization start data sending cycle, producing the result that operation is conducted in such a way that the number of synchronization start data/synchronization completion data within the unit time are maintained fixed, and increases in the number of synchronization start data/synchronization completion data and increases in the load on the master/slave may be prevented.

Further, each node on the network monitors the network connection; when the connection is electrically (physically) cut each node maintains the state immediately before the connection is severed and stops; each node continues monitoring the network connection; and at the time of re-connecting the master node and the slave nodes both join the network in the state immediately before the connection is severed, that is, the master node join the network as the master and the slave nodes join the network as the slaves, producing the result that disorder of the network is suppressed to a minimum and smooth data transfer can be realized.

Further, regarding the restoration of the network, a node having as its address in the management table a specific address as the master joins the network as the master at the time of re-connection, even in the case when the state of this node immediately before the connection is severed was that of a slave. Thus, there is provided one method for restoring the failure in which a master does not exist on the network, and failure resistant data transfer becomes possible.

Further, in the case when, due to some cause, the above-mentioned network is severed physically (electrically) in the middle thereof, restoration is performed on both of the severed networks, and a nodes operating as the master on each of the networks are controlling the network, at the time when the severed connections connect again and form one network, when the master nodes of each network compete for the master right of the single network, the single node capable of acquiring the master right may be determined from the two compound conditions of whether there exist slave nodes on the networks of the competing master nodes, and the priority level of the network addresses in the above-mentioned management table. Thus there is provided one method for restoring failures in which a plurality of masters exists on the network, and failure resistant data transfer becomes possible.

Further, moving of the master right in the above-mentioned network to another node (slave) is realized by means of negotiation by the host CPU of the node via the network, producing an effect such that the possibility that the movement of the master right, which performs an extremely significant function for smoothly conducting the operation of the network, is performed by the communications device alone without intervention by the host CPU to thereby cause instability in the network operations, is eliminated.

What is claimed is:

1. A communications control system for elevators having a plurality of control units including respective car control units and elevator hall registration control units, each of said plurality of control units having a node, the plurality of nodes being connected to each other via a network, and each of said nodes having a management table establishing correspondence between a node number and a network address, said elevator communications control system comprising:

a node acting as a master and, when a first network address corresponding to the node number of this node is, upon referring to the management table, a specific address in the management table, sending to all other nodes a broadcast communication to notify that this node is a temporary master and having the first network address added thereto, and receiving from another temporary master a broadcast communication for notifying that this other node is a temporary master having a second network address with the node number of this other temporary master added thereto, if the first network address and the second network address conform to specific conditions; and a node acting as a slave and, when the network address corresponding to the node number of this node is not a specific address in the management table or the first network address corresponding to the node number of this node is a specific address in the management table, upon referring to the management table, sending to all other nodes a broadcast communication to notify that this node is a temporary master having the first network address added thereto and receiving from another temporary master a broadcast communication for notifying that this other node is the temporary master having a second network address corresponding to the node number of this other temporary master added thereto, if the first network address and the second network address do not conform to specific conditions, wherein said node acting as the master sends synchronization start data to one slave from among a plurality of slaves;

receives synchronization completion data from the slave to send subsequent synchronization start data to a subsequent slave, in order; and adjusts the timing for sending synchronization start data so that it matches a target cycle, assuming that an interval for sending the synchronization start data is a synchronization start data sending cycle, based on: an amount of time from the sending of the synchronization start data until the receiving of the synchronization completion data; an amount of time required for sending the data, being calculable from a number of sending data stored in a sending buffer until the time of sending; and a target time for the synchronization start data sending cycle.

2. The communications control system for elevators according to claim 1, wherein each of said nodes on the network monitors a network connection, stops at a time when the network connection is electrically severed while maintaining the state immediately before the network connection is severed, and continues monitoring the network connection, and both the master node and slave nodes join the network in the state immediately before the network connection is severed at a time when the network is restored and reconnection occurs.

3. The communications control system for elevators according to claim 2, wherein, at the time when the network is restored, a node having a specific address as the master in the management table joins as the master at the time of the reconnection, even when the node was a slave immediately before the connection was severed.

4. The communications control system for elevators according to claim 1, wherein when, after, the network is physically severed, restoration takes place in each of two severed networks, nodes operating as the masters on each of the networks are controlling those networks, and a single network is formed again, the master nodes of each network compete for a master right of the single network, and a single node acquiring the master right is determined based on a combination of:

(1) whether there exist slave nodes on the networks of the competing nodes; and (2) comparison of priority levels defined by the network addresses in the management tables.

5. The communications control system for elevators according to claim 4, wherein moving of the master right in the single network to another node is realized by negotiation between host CPUs of the nodes via the single network.

* * * * *